United States Patent [19]

Dziedzic

[11] 4,068,707

[45] Jan. 17, 1978

[54] MATRIX STRUCTURE AND METHOD FOR MAKING

[75] Inventor: Chester John Dziedzic, Dushore, Pa.

[73] Assignee: GTE Sylvania Incorporated, Stamford, Conn.

[21] Appl. No.: 661,261

[22] Filed: Feb. 25, 1976

[51] Int. Cl.[2] ..... F28D 19/04

[52] U.S. Cl. ..... 165/8; 65/44; 165/10

[58] Field of Search ..... 165/8, 10; 65/44, 33

[56] References Cited

U.S. PATENT DOCUMENTS

| | | | |
|---|---|---|---|
| Re. 19,140 | 4/1934 | Fränkl | 165/10 |
| 3,276,515 | 10/1966 | Whitfield | 165/8 X |
| 3,311,204 | 3/1967 | Barnard | 165/8 X |
| 3,534,807 | 10/1970 | Bracken, Jr. | 165/10 X |
| 3,576,208 | 4/1971 | Cassidy | 165/10 X |
| 3,582,301 | 6/1971 | Andrysiak et al. | 165/10 X |
| 3,789,916 | 2/1974 | Lindahl | 165/10 X |
| 3,897,819 | 8/1975 | Huebner et al. | 165/10 X |

FOREIGN PATENT DOCUMENTS

| | | | |
|---|---|---|---|
| 805,548 | 2/1969 | Canada | 165/8 |
| 2,512,817 | 10/1975 | Germany | 165/8 |

*Primary Examiner*—Charles J. Myhre
*Assistant Examiner*—Sheldon Richter
*Attorney, Agent, or Firm*—Norman J. O'Malley; Lawrence R. Fraley; Donald R. Castle

[57] ABSTRACT

There is described an improved matrix structure for use in a heat regenerator for a turbine engine. The improvement comprises providing the structure's outer region with a plurality of corrugated and flat ceramic strips, a substantial portion of said strips of a thickness greater than the thickness of the structure's operative region. A method for making the structure is also disclosed.

22 Claims, 5 Drawing Figures

MATRIX STRUCTURE AND METHOD FOR MAKING

BACKGROUND OF THE INVENTION

This invention relates to matrix structures and more particularly to matrix structures comprised of ceramic material. Even more particularly, the invention relates to annular ceramic matrix structures adapted for use in heat regenerators typically found in many turbine engines.

Ceramic structured heat regenerators have found wide acceptance in many of today's turbine engine industries. Engines of this variety are desired in the automotive and aircraft fields primarily because of their high operating efficiencies. Such high efficiencies are in turn the result of the regenerator's ability to recover waste heat losses and to preheat air coming into the engine. Accordingly, a decrease in the level of fuel consumption and noxious exhaust emissions can be expected.

In most cases, the heat regenerator is an annular member which slowly rotates within the turbine engine during operation. The ceramic structure of the regnerator is comprised of a plurality of alternating corrugated and flat ceramic strips which define a plurality of cellular flow passages axially oriented about the axis of rotation of the member. Exhaust gases which are emitted from the engine's combustion region pass through a portion of this regenerator and thus serve to heat said portion. As the heated portion is rotated to the region of the engine through which passes the incoming cool air, this air is heated. As is well understood in engine technology, preheated air having a quantity of fuel therein is more easily ignited than cool air having same. The result is an immediate increase in engine efficiency.

A particular problem with known ceramic matrix structured heat regenerators of the rotary variety is their relatively low strength. As can be appreciated, several stresses e.g. compressive and tensile, are present during operation of the turbine's regenerator and in many cases, several regenerators have failed due to these stresses.

Stresses are also present in the formation of the ceramic structure from the green (unfired) to the completed (fired) state. During the firing operation, stresses are induced as a result of the shrinkage of the green ceramic, said shrinkage resulting from the removal of plastic forming aids present in most ceramic compositions. Usually, a structure of ceramic particles dispersed in about 30 percent by weight of a plastic supporting matrix exhibits a shrinkage during firing within the range of from about 3 to 12 percent, with a 5–6 percent range typically occurring.

It is believed therefore that an improved ceramic matrix structure and method for making same wherein the resulting structure exhibits a significantly increased strength against stresses typically occuring during most known matrix forming processes as well as those present in most turbine engine operations would constitute an advancement in the art.

OBJECTS AND SUMMARY OF THE INVENTION

It is therefore a primary object of this invention to provide an improved annular ceramic matrix structure for use as a heat regenerator in turbine engines.

It is another object of this invention to provide an improved method for making said structure.

In accordance with one aspect of the present invention, there is provided an improved annular matrix structure for use in a rotary heat regenerator for a turbine engine. The matrix of the structure includes an inner operative region and an outer region substantially about said inner region. The operative region of the matrix is defined by a plurality of radially alternating corrugated and flat ceramic strips each of a pre-established thickness and secured together to define a plurality of radially sealed axial flow passages. The improvement to the structure comprises providing the outer region of a plurality of corrugated and flat ceramic strips radially disposed in a predetermined pattern with a substantial portion of these strips of a thickness substantially greater than the pre-established thickness of the ceramic strips of the operative region.

In accordance with another aspect of the present invention, there is provided a method for making an annular matrix structure adapted for use in a rotary heat regenerator for a turbine engine, said matrix incuding an inner operative region and an outer region. The method includes forming the innner operative region of a plurality of radially alternating corrugated and flat ceramic strips each of a pre-established thickness and secured together to define a plurality of radially sealed axial flow passages. The method further comprises forming the outer region substantially about the inner region. The improvement to the method comprises forming said outer region with a plurality of corrugated and flat ceramic strips radially disposed in a predetermined pattern wherein a substantial portion of said strips are of a thickness substantially greater than the preestablished thickness of the ceramic strips of the operative region.

DETAILED DESCRIPTION OF THE PREFERRED EMBODIMENTS

For a better understanding of the present invention, together with other and further objects, advantages, and capabilities thereof, reference is made to the following specification and appended claims in connection with the above-described drawings.

Figure 1:
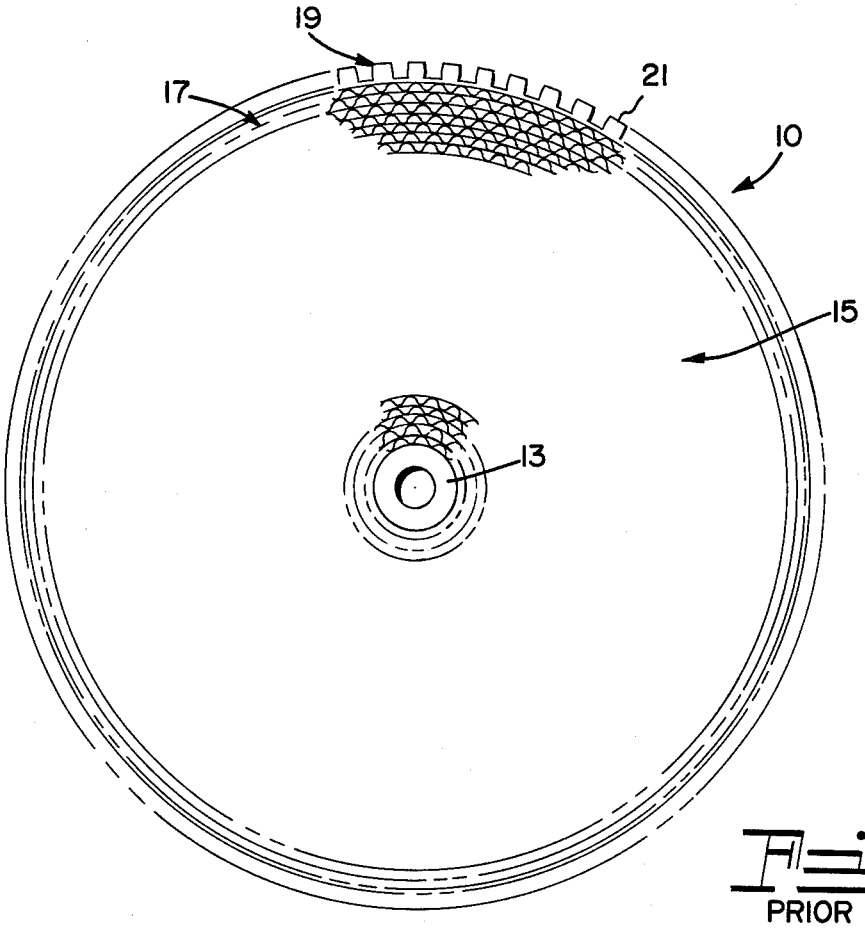
Fig. 1 PRIOR ART
FIG. 1 represents a side elevational view of a rotary heat regenerator known in the prior art.

With particular reference to FIG. 1, there is shown a rotary heat regenerator 10 typical to the prior art. Regenerators of this variety, as described in U.S. Pat. No. 3,401,741, typically comprise a centrally located ring or bearing member 13, an inner operative matrix region 15, and an outer matrix region 17 substantially about inner region 15. As described in the above-cited patent, the structure's outermost region is adapted for having a drivable means 19 affixed thereto. Driveable means 19, preferably a ring gear 21, is affixed to the structure and is driven by a corresponding pinion gear (not shown) once the regenerator 10 is located within the desired turbine engine. Various means are utilized to affix the outer ring gear to the fired matrix of the regenerator. The method preferred in the cited patent is to use a plurality of spring clips which are partially embedded within outer region 17. Another method known in the prior art and preferably utilized with annular matrix structures as produced by the present invention is to use an elastomer strategically positioned about the outermost portion of the matrix structure with ring gear 21 bonded thereto. The method for affixing ring gear 21 to the outer region 17 does not constitute an essential feature of the present invention and therefor further description is not considered necessary. It will be understood, however, that the strengthened matrix structure as taught by the present invention will facilitate positioning of ring gear 21 regardless of the method employed.

The operative region 15 of most known regenerators comprises a plurality of radially alternating corrugated and flat ceramic strips each of a preestablished thickness and secured together to define a plurality of radially sealed axial flow passages therein. Said flow passages permit the passage of incoming air through a portion of the regenerator as well as passage of the exhaust gases from within the engine. Thus, as the regenerator rotates within the desired turbine engine, the operative region 15 of the matrix is heated by the exhaust gases and continuously rotates to heat the incoming cool air which is fed the engine.

As further typified by the prior art, the operative and outer regions 15 and 17 respectively are each comprised of a plurality of alternating corrugated and flat ceramic strips. Typical thicknesses for such strips in the fired form of the matrix structure for regenerators as shown in FIG. 1 are within the range of about 0.004 inches to about 0.005 inches. That is, each of the alternating strips (both corrugated and flat) are of this preferred preestablished uniform thickness.

As stated, a problem inherent in most regenerators of the prior art has been the relatively low strength of the matrix structure once the structure is in the fired condition and therefore adapted for having the drivable means 19 secured thereto. Such structures also possess low strength particularly during the firing operation when the green ceramic structure is subjected to the relatively high temperatures required during said firing. On many occasions, the mentioned stresses typically found in engine operation and during the described firing processes have caused collapse or similar breakage of the matrix structure.

It is to be understood with regard to most regenerators that the operative region 15 is the only portion of the matrix structure which is subjected to incoming and exhaust fluid passage. The outer region 17 of most regenerators is often referred to as the inoperative region and is not subjected to said passage. Usually, this outer region is filled with a cement or similar material after the structure has been formed.

Figure 2:
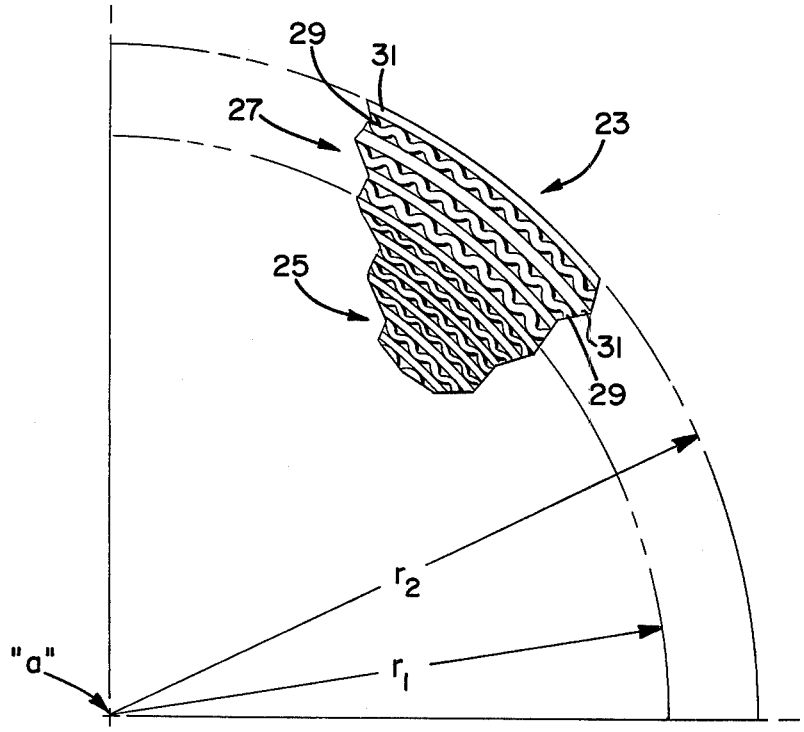
FIGS. 2–4 illustrate various embodiments of the annular matrix structure of the present invention.
Figure 3:
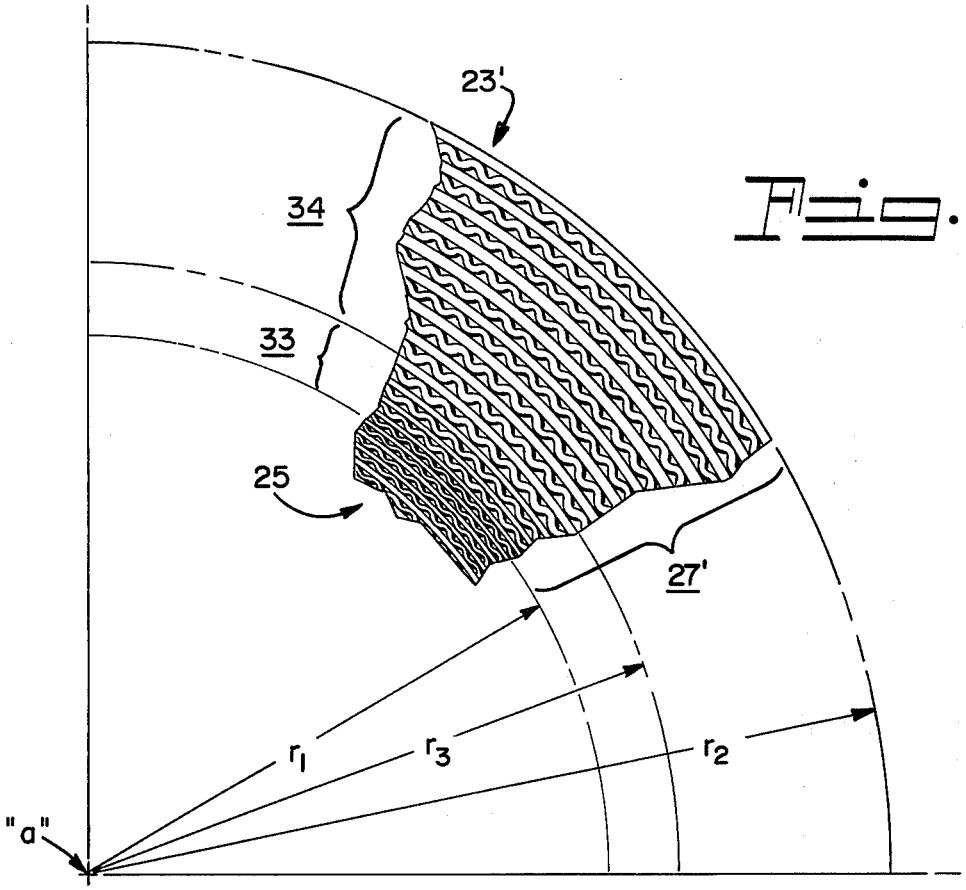
Figure 4:
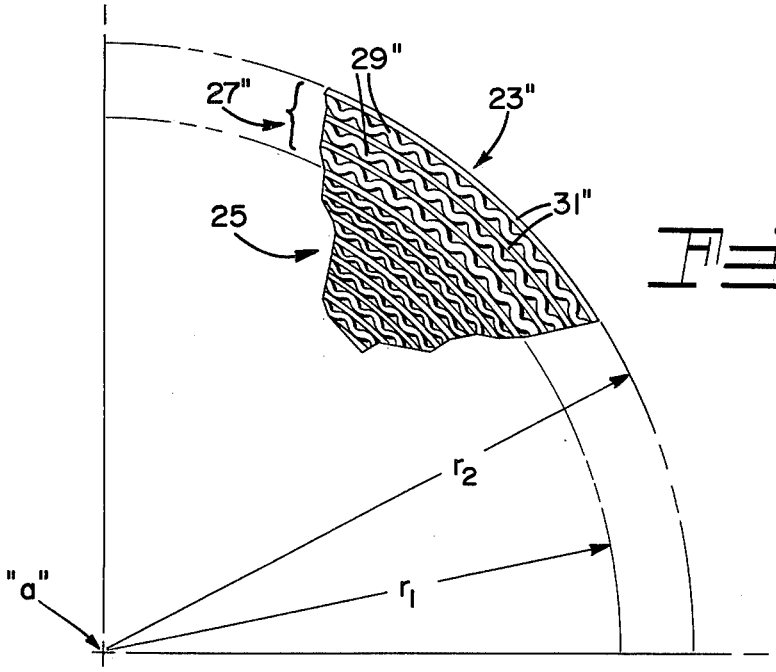

With particular regard to FIGS. 2–4, there is illustrated an improved annular matrix structure adapted for use in a rotary heat regenerator for a turbine engine. As will be defined, this annular structure is adapted for having the previously described drivable means, e.g. ring gear 21, affixed thereto.

In FIG. 2, an improved annular matrix structure 23 is shown and defined as including an inner operative region 25 and an outer region 27 substantially about operative region 25. Although only a portion of structure 23 is shown in FIG. 2, it is understood that the overall configuration of this structure is annular and each of the ceramic strips of regions 25 and 27 are radially disposed about a central axis "*a*," which extends substantially perpendicular from the drawing. The inner operative region 25 is that of the annular structure from the central axis "*a*" out to the region defined by $r_1$. The outer region of structure 23 is that region between the furthermost portion as defined by $r_1$ and the portion defined by $r_2$. Thus, it is understood that $r_1$ and $r_2$ represent the radii respectively to each of the outermost portions of regions 25 and 27 from axis "a." The operative region 25 of matrix structure 23 is substantially similar to that of the operative region of many known prior art matrix structures. Accordingly, the thickness for each of the alternating corrugated and flat ceramic strips of this region is preferably uniform and typically within the range of from about 0.004 to about 0.005 inches. As stated, typical outer regions of most known ceramic structures for regenerators have also comprised a plurality of radially alternating corrugated and flat ceramic strips each of a thickness substantially similar to that for operative region 25. This differs substantially from the improved matrix structure of the present invention in that the outer region 27 for structure 23 comprises a plurality of corrugated and flat ceramic strips 29 and 31 radially disposed in a predetermined pattern with at least a substantial portion of these strips of a thickness substantially greater than the preestablished thickness as described for the ceramic strips of operative region 25. By thickening a substantial portion of the ceramic strips of outer portion 27, the strength of the resulting matrix structure 23 is significantly increased over prior art structures wherein the thickness for the ceramic strips remained uniform throughout. This is particularly applicable with regard to stresses occurring during the firing process for forming structure 23. A preferred thickness for strips 29 and 31 of outer region 27 is within the range of from about 0.008 to about 0.016 inches. Thus it can be seen that the thickness of these strips is within the range of from about 2 to about 4 times greater than the established thickness for the alternating ceramic strips within operative region 25.

It will be understood with regard to the present invention that several various pattern configurations can be employed for outer matrix region 27. The embodiment shown in FIG. 2 preferably comprises an outer region 27 wherein all of the ceramic strips of this region are within the above-defined thickness ranges, e.g. 0.008 to 0.016 inches. As stated however, it is only necessary to provide a substantial portion of the strips of outer region 27 of this increased thickness. For example, it may be desirable to utilize only thickened corrugated layers 29 while the flat layers 31 remain of substantially the same thickness as the strips of operative region 25. The highly desired characteristic of increased strength for 23 will still result. An embodiment as described above is shown in FIG. 4.

It is also within the broad aspects of the present invention to incorporate thickened flat layers 31 within outer region 27 while maintaining the thicknesses for corrugated layers 31 within the ranges defined for the strips of operative region 25. It can therefore be understood that if every other ceramic strip is of a thickness substantially greater than the strips of the operative region while the remaining strips in region 27 are of substantially the same thickness, a substantial portion would comprise at least 50 percent of these strips. Various other configurations can satisfactorily be employed, as will be understood with the description of the following embodiments.

With regard to the present invention, it is preferred to position strips 29 and 31 of outer portion 27 in an alternating pattern radially disposed in the structure 23 about the central axis "*a*" and therefore about operative region 25. With further regard of the present invention, it is preferred that the total cross-sectional area for outer region 27 be within the range of from about 8 percent to about 11 percent of the total cross-sectional area of matrix structure 23. A typical size for annular matrix structures as defined above is one in which the diameter of the structure is greater than 25 inches. This is not meant to limit the present invention however in that the improvement as described above may also be incorporated within matrix structures of much smaller diameters. The present invention has successfully been incorporated within matrix structures ranging from 17 to about 30 inches and may be incorporated within structures having both smaller and larger diameters.

FIG. 3 represents an alternate embodiment of the present invention, matrix structure 23'. Herein, it is shown that outer region 27' includes a transition region 33 which is located substantially about the previously defined operative region 25 and a peripheral region 34 which is located substantially about transition region 33. The ceramic strips of the transition region 33 are of varying thicknesses, each of these thicknesses greater than the preestablished thickness for the ceramic strips of operative region 25. Furthermore, the thickness for the strips within transition region 33 is less than the thicknesses for a substantial portion of the ceramic strips of the remainder of outer region 27', that being peripheral region 34. For example, utilizing fired ceramic strips of approximately 0.004 inch thickness for operative region 25 and ceramic strips having a thickness of approximately 0.010 inches for a substantial portion of the strips of peripheral region 34, it is preferred to utilize strips having thicknesses varying from 0.005 to 0.009 inches for transition region 33. It is further preferred that this described thickness range increase proportionately from the portion of transition region 33 immediately adjacent operative region 25 to the portion of transition region 33 immediately adjacent peripheral region 34. That is, the strips of transition region 33 adjacent operative region 25 will be of approximately 0.005 inch wall thickness and the strips immediately adjacent peripheral region 34 will be approximately 0.009 inches thick.

It is once again understood that only a substantial portion of the strips of peripheral region 34 need be of the increased thicknesses defined. It is also possible, as in the case of previously described outer region 27 (FIG. 2), that all of the strips of this region can be of said increased thickness. This is the preferred embodiment, as illustrated in FIG. 3. The same varying configuration possibilities for corrugated and flat layers 29' and 31' respectively also exist as in the case of those for previously defined outer region 27.

In FIG. 3, $r_1$ is provided to define the outermost portion of operative region 25 and therefor the first portion of transition region 33. Accordingly, $r_3$ is used to designate the boundary between the outermost portion of transition region 33 and the innermost portion of peripheral region 34. Furthermore, $r_2$ is utilized to designate the outermost portion (or perimeter) of outer region 27'. Once again, "*a*" represents the axis of matrix structure 23'.

It can further be seen in FIG. 3 that the corrugated and flat ceramic strips of outer region 27' are radially disposed in an alternating pattern about operative region 25. This preferred positioning pattern is not meant to limit the broad aspects of the present invention however in that other patterns may be successfully used. For example, it is possible to provide a pattern wherein a plurality of adjacent flat layers are utilized followed by a plurality of adjacent corrugated layers, followed again by a plurality of flat layers, etc. Or it may be possible to utilize a plurality of flat layers, a singular corrugated layer, another plurality of flat layers, a singular flat corrugated layer, etc. Thus it can readily be seen that because several varying positioning patterns are possible for outer region 27', the positioning of the ceramic strips in the alternating pattern as shown is not meant to limit the present invention.

When producing a fired ceramic matrix structure having an outside diameter of 28.250 inches, it is preferred that $r_1$ be about 13.375 inches. Additionally, it is preferred that $r_3$ be about 13.625 inches. It is understood that $r_2$ is 14.125 inches. It can be seen therefor that the outer region 27' represents approximately 10 percent of the total cross-sectional area for the matrix structure 23' as illustrated in FIG. 3. This also is not meant to limit the present invention because it is permissible to utilize outer regions having a total cross-sectional area within the range of from about 8 percent to about 11 percent of the total cross-sectional area of matrix structure 23'. Although not meant to limit the invention, it is further preferred that the thicknesses of the ceramic strips of outer region 27' be within the range of from about 1.25 to about 4 times greater than the preestablished thickness of the ceramic strips within operative region 25. It is to be remembered that the defined outer region 27' includes therein the previously defined transition region 33 and peripheral region 34. P With the above defined parameters for $r_1$, $r_2$, and $r_3$ for the structure 23' in FIG. 3, it can be seen that the total cross-sectional area for the transition region 33 is approximately 33 percent of the total cross-sectional area for outer region 27'. This is not meant to limit the invention, however, in that the total cross-sectional area for transition region 33 may be within the range of from about 10 percent to about 40 percent of the total cross-sectional area of outer region 27'.

As previously described, FIG. 4 represents an alternate embodiment for an outer region 27'' for an improved matrix structure 23''. Once again, the outermost portion of operative region 25 is defined by the radius $r_1$ and the outermost portion of outer region 27'' is defined by radius $r_2$. As in the embodiment illustrated in FIG. 3, the preferred diameter for the matrix structure depicted in FIG. 4 is greater than 25 inches. Outer region 27'' is shown as comprising a plurality of alternating radially disposed corrugated and flat strips of fired ceramic material substantially similar to the pattern depicted in FIG. 2. However, in FIG. 4, the thickness of the corrugated strips 29'' has been substantially increased to within the range of from about 2 to about 4 times the thickness for the ceramic strips of operative region 25. Accordingly, the flat strips 31'' of outer region 27' have remained at substantially the same thickness for the ceramic strips of operative region 25, that being preferably about 0.004 to about 0.005 inches. When using these wall thicknesses for the flat strips in outer region 27'' and the ceramic strips in operative region 25, is is preferred that the thickness for the corrugated ceramic strips 29'' be approximately 0.010 to about 0.015 inches thick.

Figure 5:
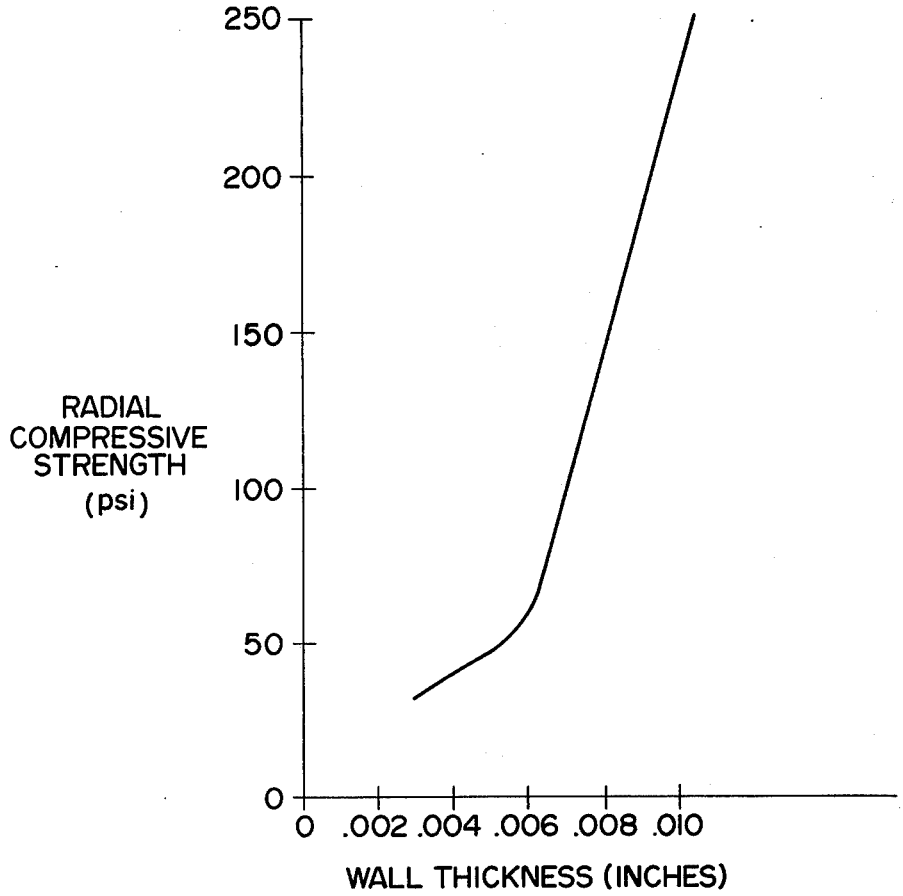
FIG. 5 is a graph illustrating the correlation between the radial compressive strength and the corresponding varying wall thicknesses for fired ceramic matrix structures.

FIG. 5 depicts a graph illustrating the significant increase in radial compressive strength (p.s.i.) verses the corresponding variation in wall thickness for the fired ceramic strips. The data as provided in the chart of FIG. 5 was obtained as a result of a series of radial compressive tests wherein various sections of fired ceramic matrix structures were tested. That is, once the fired ceramic wall thickness exceeded 0.006 inches, the corresponding radial compressive strength for the section of structure having this thickness increased almost linearly at a much greater rate than that of structures having a thickness less than 0.006 inches. Comparing the radial compressive strength findings for a wall thickness of about 0.004 inches to that of a wall thickness of 0.010, a strength increase of approximately 600 percent is realized. It can therefor be seen that by substantially increasing the outer region of a ceramic matrix structure for use in a heat regenerator, a significant increase in the radial compressive strength for the structure is achieved.

Formation of the operative region 25 for the matrix structures depicted in the drawings is achieved by methods well known in the ceramic art. Usually, a continuous bilayered green ceramic tape is wound about a central shaft or core member utilizing either heat or solvent to achieve bonding of the several layers. Thereafter, the article is heated at relatively high temperatures for predetermined time periods whereupon the resulting article is a fired ceramic structure. As defined by the present invention, the improvement of this method comprises forming an outer region of a plurality of corrugated and flat ceramic strips radially disposed in a predetermined pattern wherein at least a substantial portion of these strips is of a thickness greater than the thickness of the strips of the operative region. This outer region is formed about the operative region as defined and may be done so in much the same manner as that of the operative region. That is, at the termination of winding of operative region 25, the substantially thickened strips for the outer regions as defined in FIGS. 2–4 may be subsequently rolled about the formed operative region 25. Thereafter, heating of the matrix structure is then accomplished to achieve the desired fired state.

Due to relatively high stresses exerted during the firing of the matrix structures of the present invention, it can further be understood that increasing the thickness of the outer portions for the structures further substantially reduces the possibility of fracture or similar deformation to the structure during this firing operation.

Thus there has been shown and described an improved annular matrix structure for use in a rotary heat regenerator for a turbine engine. There also has been described an improved method for making this structure. The matrix structure of the present invention is characterized by an outer portion having a substantially increased radial compressive strength when compared to matrix structures of the known prior art.

While there has been shown and described what are at present considered the preferred embodiments of the invention, it will be obvious to those skilled in the art that various changes and modifications may be made therein without departing from the scope of the invention as defined by the appended claims.

What is claimed is:

1. In an annular matrix structure adapted for use in a rotary heat regenerator for a turbine engine wherein said matrix includes an inner operative region and an outer region substantially about said operative region and adapted for having a driveable means affixed thereto, said operative region defined by a plurality of radially alternating corrugated and flat ceramic strips each of a pre-established thickness and secured together to define a plurality of radially sealed axial flow passages, wherein said outer region comprises a plurality of corrugated and flat ceramic strips radially disposed in a predetermined pattern, a substantial portion of said strips of a thickness substantially greater than said pre-established thickness of said ceramic strips of said operative region, the improvement wherein the total cross-sectional area of said outer region is within the range from about 8% to about 11% of the total cross-sectional area of said matrix structure, and the thickness of said substantial portion of said ceramic strips of said outer region is within the range of from about 2 to about 4 times greater than said preestablished thickness of said ceramic strips of said operative region.

2. The improvement according to claim 1 wherein all of said ceramic strips of said outer region are of said thickness substantially greater than said preestablished thickness of said strips of said operative region.

3. The improvement according to claim 1 wherein said corrugated and flat ceramic strips of said outer region are radially disposed in an alternating pattern about said operative region.

4. The improvement according to claim 1 wherein the diameter of said matrix is greater than 25 inches.

5. The improvement according to claim 1 wherein said outer region includes a transition region immediately adjacent said operative region and a peripheral region substantially about said transition region, a substantial portion of said ceramic strips of said peripheral region of a thickness substantially greater than said preestablished thickness of said strips of said operative region, said ceramic strips of said transition region of varying thicknesses greater than said preestablished thickness of said strips of said operative region and less than said thickness of said substantial portion of said strips of said peripheral region.

6. The improvement according to claim 5 wherein all of said ceramic strips of said peripheral region are of said thickness greater than said preestablished thickness of said strips of said operative region.

7. The improvement according to claim 5 wherein said varying thicknesses of said ceramic strips of said transition region increase in a proportionate manner from the portion of said transition region immediately adjacent said operative region to the portion of said transition region immediately adjacent said peripheral region.

8. The improvement according to claim 5 wherein said corrugated and flat ceramic strips of said outer region are radially disposed in an alternating pattern about said operative region.

9. The improvement according to claim 5 wherein the total cross-sectional area of said outer region is within the range of from about 8 percent to about 11 percent of the total cross-sectional area of said matrix structure.

10. The improvement according to claim 5 wherein said thicknesses of said ceramic strips of said transition region and said substantial portion of said peripheral region are within the range of from about 1.25 to about 4 times greater than said preestablished thickness of said ceramic strips of said operative region.

11. The improvement according to claim 5 wherein the diameter of said matrix structure is greater than 25 inches.

12. The improvement of claim 11 wherein the total cross-sectional area of said transition region is within the range of from about 10 percent to about 40 percent of said total cross-sectional area of said outer region.

13. In a method of making an annular matrix structure adapted for use in a rotary heat regenerator for a turbine engine wherein said matrix includes an inner operative region and an outer region and wherein said method includes forming said inner operative region of a plurality of radially alternating corrugated and flat ceramic strips, each of a preestablished thickness and secured together to define a plurality of radially sealed axially flow passages, and forming said outer region substantially about said inner region, wherein said outer region is formed of a plurality of corrugated and flat ceramic strips radially disposed in a predetermined pattern, a substantial portion of said strips of a thickness substantially greater than said preestablished thickness of said ceramic strips of said operative region, the improvement wherein the total cross-sectional area of said outer region is within the range of from about 8% to about 11% of the total cross-sectional area of said matrix structure, and the substantial portion of said ceramic strips of said outer region is of a thickness within the range of from about 2 to about 4 times said preestablished thickness of said ceramic strips of said operative region.

14. The improvement according to claim 13 including forming all of said ceramic strips of said outer region of said thickness greater than said preestablished thickness of said strips of said operative region.

15. The improvement according to claim 13 wherein said outer region is formed by radially disposing said corrugated and flat ceramic strips in an alternating pattern about said operative region.

16. The improvement according to claim 13 wherein all of said ceramic strips of said peripheral region are of said thickness greater than said preestablished thicknesses of said strips of said operative region.

17. The improvement according to claim 13 wherein a transition region and a peripheral region are formed as parts of said outer region, said transition region formed immediately adjacent said operative region and said peripheral region formed substantially about said transition region, a substantial portion of said ceramic strips of said peripheral region of a thickness substantially greater than said thickness of said strips of said peripheral region, said ceramic strips of said transition region greater than said preestablished thickness of said strips of said operative region and less than said thickness of said substantial portion of said strips of said peripheral region.

18. The improvement according to claim 17 wherein said ceramic strips of said transition region are of proportionately increasing thicknesses from the portion of said transition region immediately adjacent said operative region of the portion of said transition region immediately adjacent said peripheral region.

19. The improvement according to claim 17 wherein said outer region is formed by radially disposing said corrugated and flat ceramic strips of said outer region in an alternating pattern about said operative region.

20. The improvement according to claim 17 wherein the total cross-sectional area of said outer region is within the range of from about 8 percent to about 11 percent of the total cross-sectional area of said matrix structure.

21. The improvement according to claim 17 wherein said thicknesses of said ceramic strips of said transition region and said substantial portion of said peripheral region are within the range of from about 1.25 to about 4 times said preestablished thickness of said ceramic strips of said operative region.

22. The improvement according to claim 17 wherein the total cross-sectional area of said transition region is within the range of from about 10 percent to about 40 percent of said total cross-sectional area of said outer region.

* * * * *